US012385678B2

(12) United States Patent
Xiong et al.

(10) Patent No.: US 12,385,678 B2
(45) Date of Patent: Aug. 12, 2025

(54) REFRIGERANT LEAK DETECTION USING A SENSOR-READING CONTEXT ANALYSIS

(71) Applicant: Carrier Corporation, Palm Beach Gardens, FL (US)

(72) Inventors: Ziyou Xiong, Wethersfield, CT (US); Michael Birnkrant, Wethersfield, CT (US); Marcin Piech, East Hampton, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 183 days.

(21) Appl. No.: 18/303,728

(22) Filed: Apr. 20, 2023

(65) Prior Publication Data

US 2023/0341160 A1 Oct. 26, 2023

Related U.S. Application Data

(60) Provisional application No. 63/335,014, filed on Apr. 26, 2022.

(51) Int. Cl.

| | |
|---|---|
| ***F24F 11/36*** | (2018.01) |
| ***F25B 49/00*** | (2006.01) |
| ***F28F 27/00*** | (2006.01) |

(52) U.S. Cl.

CPC ..... *F25B 49/005* (2013.01); *F24F 11/36* (2018.01); *F28F 27/00* (2013.01); *F25B 2500/222* (2013.01); *F28F 2265/16* (2013.01)

(58) Field of Classification Search

CPC ..... F24F 11/36; F25B 49/005; F25B 250/222
See application file for complete search history.

(56) References Cited

U.S. PATENT DOCUMENTS

| | | | | |
|---|---|---|---|---|
| 11,125,457 | B1 * | 9/2021 | Alfano | F24F 11/36 |
| 2013/0036796 | A1 | 2/2013 | Fleury, Jr. et al. | |
| 2014/0005958 | A1 | 1/2014 | Baliga | |
| 2016/0109162 | A1 | 4/2016 | Suzuki et al. | |
| 2019/0170603 | A1 | 6/2019 | Gupte et al. | |
| 2021/0356155 | A1 * | 11/2021 | Yoshimi | F24F 11/36 |

FOREIGN PATENT DOCUMENTS

EP 3511657 A1 7/2019

OTHER PUBLICATIONS

European Application No. 23170074.1 filed Apr. 26, 2023; Extended European Search Report dated Sep. 18, 2023; 11 pages.

* cited by examiner

*Primary Examiner* — Jonathan Bradford
(74) *Attorney, Agent, or Firm* — CANTOR COLBURN LLP

(57) ABSTRACT

A detection assembly operable to detect a refrigerant leak event includes a sensor network and a controller. The sensor network is operable to generate sensor outputs including triggering-sensor (TS) outputs and triggering-sensor context (TSC) outputs. The controller is operable to perform a sensor-reading context analysis on the sensor outputs. The sensor-reading context analysis includes accessing a set of the sensor outputs that occurred within a context time window, along with determining that a pattern of the set of sensor outputs represents the refrigerant leak event.

20 Claims, 6 Drawing Sheets

REFRIGERANT LEAK DETECTION USING A SENSOR-READING CONTEXT ANALYSIS

CROSS-REFERENCE TO RELATED APPLICATIONS

This application claims the benefit of U.S. Provisional Application No. 63/335,014 filed Apr. 26, 2022, the disclosure of which is incorporated herein by reference in its entirety.

BACKGROUND

Exemplary embodiments of the present disclosure relate to refrigerant detection assemblies for detecting leaks of moderate to low global warming potential (GWP) refrigerants, and more particularly, to refrigerant leak detection systems and methods operable to detect refrigerant leaks using a novel sensor-reading context analysis.

A wide variety of technologies exist for cooling applications, including but not limited to evaporative cooling, convective cooling, or solid state cooling such as electrothermic cooling. One of the most prevalent technologies in use for residential and commercial refrigeration and air conditioning is the vapor compression refrigerant heat transfer loop. Although existing refrigerants are effective coolants, the effect they can have on the environment has led to the institution of requirements that new refrigerants, which have moderate-to-low GWP values, be employed instead. Moderate-to-low GWP refrigerants A2L refrigerants) can be mildly flammable and thus their use in air conditioning systems can present risks that need to be addressed. In particular, to the extent that refrigerant leaks are possible in air conditioning systems, it is desirable to have a reliable and accurate leak detection system in place when moderate-to-low GWP refrigerants are in use in heating, ventilation, air conditioning and refrigeration (HVAC&R) products and other similar systems.

Refrigerant leaks can be detected using various types of refrigerant detection assemblies. Conventional refrigerant detection assemblies utilize threshold-based refrigerant leak detectors, such as a nondispersive infrared (NDIR) sensor or a metal-oxide-semiconductor-based (MOS-based) sensor, that compare sensor values with a single threshold to decide whether to trigger an alarm. However, such threshold-based detection schemes have the drawback of false alarms (i.e., generating a leak alarm when no leak has actually occurred) at a rate that is higher than acceptable for most applications. Frequent false alarms lead to downtime and require visits from technicians, thereby compromising the trustworthiness of the overall refrigerant detection system and, more specifically, the trustworthiness of the refrigerant detection sensors used in the detection system.

BRIEF DESCRIPTION

According to an embodiment, a detection assembly operable to detect a refrigerant leak event includes a sensor network and a controller. The sensor network is operable to generate sensor outputs including triggering-sensor (TS) outputs and triggering-sensor context (TSC) outputs. The controller is operable to perform a sensor-reading context analysis on the sensor outputs. The sensor-reading context analysis includes accessing a set of the sensor outputs that occurred within a context time window, along with determining that a pattern of the set of sensor outputs represents the refrigerant leak event.

In addition to one or more of the features described above, or as an alternative to any of the foregoing embodiments, the controller includes a classifier operable to execute a machine learning algorithm trained to perform the sensor-reading context analysis as a classification task.

In addition to one or more of the features described above, or as an alternative to any of the foregoing embodiments, the machine learning algorithm has been trained using a training dataset including experimental data that results from experimental tests applied to the detection assembly, along with in-use data that results from in-use operations of the detection assembly.

In addition to one or more of the features described above, or as an alternative to any of the foregoing embodiments, accessing the set of the sensor outputs that occurred within the context time window is based at least in part on a determination that at least one of the TS outputs represents a triggering event.

In addition to one or more of the features described above, or as an alternative to any of the foregoing embodiments, the triggering event includes the at least one of the TS outputs exceeding a threshold.

In addition to one or more of the features described above, or as an alternative to any of the foregoing embodiments, the at least one of the TS outputs includes a parameter of a refrigerant flowing through a closed loop refrigeration circuit.

In addition to one or more of the features described above, or as an alternative to any of the foregoing embodiments, the parameter includes a concentration.

In addition to one or more of the features described above, or as an alternative to any of the foregoing embodiments, the sensor network includes a triggering sensor operable to generate the TS outputs, along with a first type of context sensor operable to generate a first type of the TSC outputs.

In addition to one or more of the features described above, or as an alternative to any of the foregoing embodiments, the sensor network further includes a second type of context sensor operable to generate a second type of the TSC outputs.

In addition to one or more of the features described above, or as an alternative to any of the foregoing embodiments, the first type of the TSC outputs include temperature data that represents ambient temperature of the triggering sensor; and the second type of the TSC outputs includes humidity data that represents ambient humidity of the triggering sensor.

According to another embodiment, a method of operating a detection assembly to detect a refrigerant leak event includes using a sensor network to generate sensor outputs that include triggering-sensor (TS) outputs and triggering-sensor context (TSC) outputs. A controller is used to perform a sensor-reading context analysis on the sensor outputs. The sensor-reading context analysis includes accessing a set of the sensor outputs that occurred within a context time window, along with determining that a pattern of the set of sensor outputs represents the refrigerant leak event.

In addition to one or more of the features described above, or as an alternative to any of the foregoing embodiments, the controller includes a classifier operable to execute a machine learning algorithm trained to perform the sensor-reading context analysis as a classification task.

In addition to one or more of the features described above, or as an alternative to any of the foregoing embodiments, the machine learning algorithm has been trained using a training dataset including experimental data that results from experimental tests applied to the detection assembly, along with in-use data that results from in-use operations of the detection assembly.

In addition to one or more of the features described above, or as an alternative to any of the foregoing embodiments, accessing the set of the sensor outputs that occurred within the context time window is based at least in part on a determination that at least one of the TS outputs represents a triggering event.

In addition to one or more of the features described above, or as an alternative to any of the foregoing embodiments, the triggering event includes the at least one of the TS outputs exceeding a threshold.

In addition to one or more of the features described above, or as an alternative to any of the foregoing embodiments, the at least one of the TS outputs includes a parameter of a refrigerant flowing through a closed loop refrigeration circuit.

In addition to one or more of the features described above, or as an alternative to any of the foregoing embodiments, the parameter includes a concentration.

In addition to one or more of the features described above, or as an alternative to any of the foregoing embodiments, the sensor network includes a triggering sensor operable to generate the TS outputs, along with a first type of context sensor operable to generate a first type of the TSC outputs.

In addition to one or more of the features described above, or as an alternative to any of the foregoing embodiments, the sensor network further includes a second type of context sensor operable to generate a second type of the TSC outputs.

In addition to one or more of the features described above, or as an alternative to any of the foregoing embodiments, the first type of the TSC outputs include temperature data that represents ambient temperature of the triggering sensor; and the second type of the TSC outputs includes humidity data that represents ambient humidity of the triggering sensor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed systems and methods are presented herein by way of exemplification and not limitation with reference to the Figures.

Embodiments of the present disclosure provide methods and systems that improve the trustworthiness of refrigerant sensors in refrigerant leak detection assemblies. Embodiments of the refrigerant leak detection systems and methods described herein utilize a novel sensor-reading context analysis to detect refrigerant leaks. In some aspects, the novel sensor-reading context analysis uses a sensor network that includes refrigerant sensors operable to detect parameters of a refrigerant (i.e., "refrigerant parameters"), along with context sensors operable to detect parameters that can impact how the refrigerant sensor operates (i.e., "refrigerant-sensor context parameters"). More specifically, the refrigerant-sensor context parameters can cause the refrigerant sensor to output false alarm data that indicates a refrigerant leak when in fact no refrigerant leak has occurred. By incorporating refrigerant-sensor context parameters into the leak detection determination, operating conditions that can impact how the refrigerant sensor operates are taken into account so that false alarm conditions can be reduced and, in most instances, averted.

In some aspects, the sensor-reading context analysis utilizes a classifier having machine learning algorithms trained to determine whether features of the refrigerant parameters and the refrigerant-context parameters match the features of a refrigerant leak event. In some aspects, the machine learning algorithms extract features from how the refrigerant parameters and the refrigerant context parameters change over time. In some aspects, the classifier is trained using a training dataset developed from lab-based experimental tests and in-use tests applied to the refrigerant sensor. As a non-limiting example, the refrigerant parameters can include refrigerant concentration; and the refrigerant-context parameters can include ambient humidity and/or ambient temperature of the refrigerant sensor. Accordingly, embodiments described herein improve the trustworthiness of refrigerant sensors by greatly reducing false alarm rates with no or little compromise in detection rate; reducing refrigerant system downtime; and reducing the need for service visits from technicians in response to leak detection system false alarms.

Figure 1:
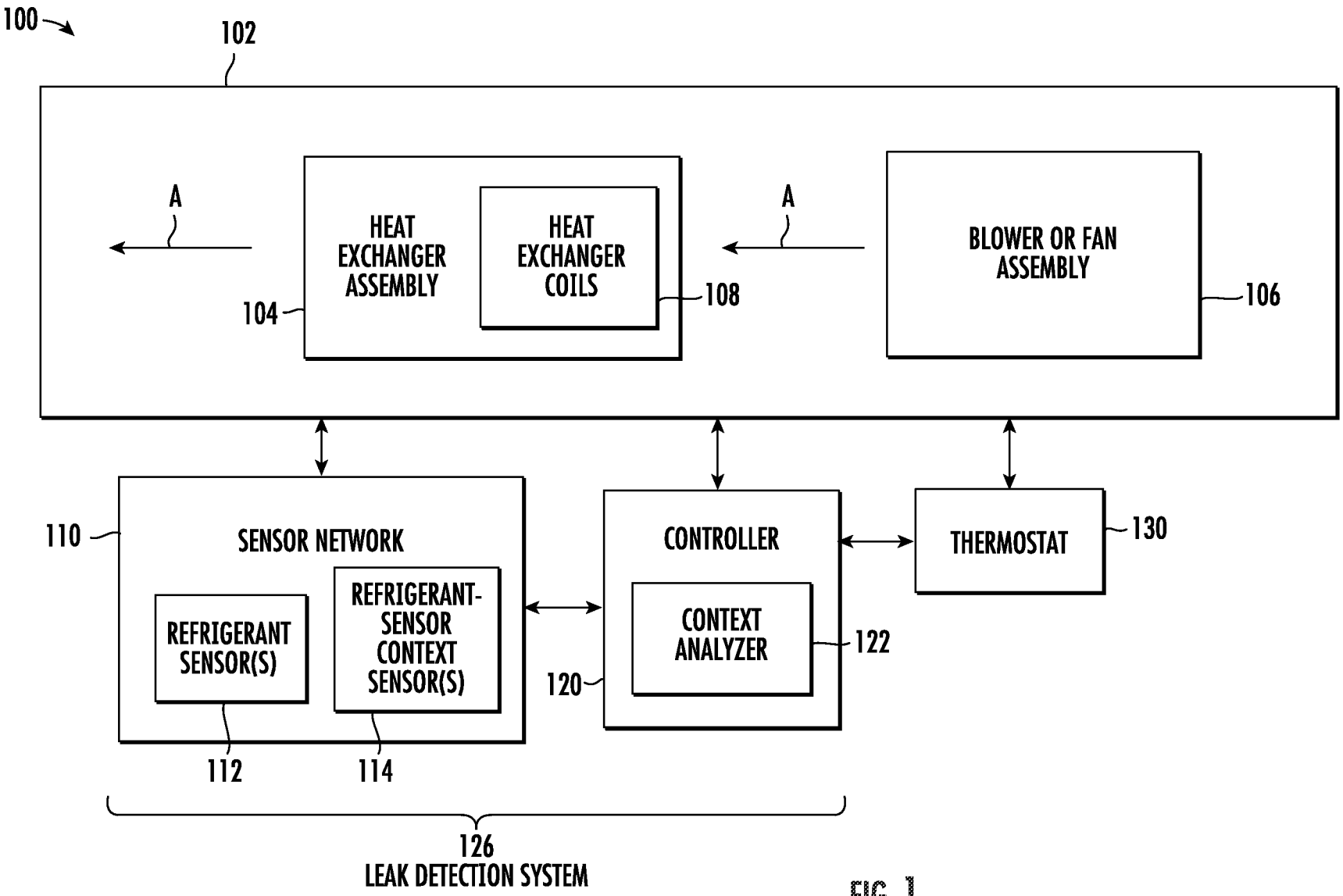
FIG. 1 is a block diagram of an exemplary heating, ventilation, and air conditioning (HVAC) system operable to implement a novel sensor-reading context analysis according to an embodiment.

With reference now to FIG. 1, embodiments of the disclosure can be applied to a wide variety of technologies for cooling applications, including but not limited to evaporative cooling, convective cooling, or solid state cooling such as electrothermic cooling. One of the most prevalent cooling technologies in use for residential and commercial refrigeration and air conditioning is the vapor compression refrigerant heat transfer loop. FIG. 1 illustrates an example of a heating, ventilation, and air conditioning (HVAC) system. 100 operable to incorporate a leak detection system 126 in accordance with aspects of the disclosure. For ease of illustration, the leak detection system 126 is depicted separately from the cabinet 102. However, it is understood that some or all of the functionality of the leak detection system 126 can also be incorporated within the cabinet 102.

The HVAC system 100 is depicted in FIG. 1 as a furnace coil or fan coil unit 100. Although described herein as furnace or fan coil unit it should be appreciated that the HVAC system 100 can be any heating or cooling system. As shown, the furnace coil or fan coil unit 100 includes a cabinet or housing duct 102 within which various components of the HVAC system are located. For example, housed within the cabinet 102 of the furnace coil or fan coil unit 100 is a heat exchanger assembly 104 operable to heat and/or cool the adjacent air. A blower or fan assembly 106 can also be arranged within the cabinet 102 or alternatively, at a position outside of but in fluid communication with the cabinet 102. The blower 106 is operable to circulate a flow of air A through the interior of the cabinet 102, across the heat exchanger assembly 104. Depending on the desired characteristics of the furnace coil or fan coil unit 100, the blower 106 can be positioned either downstream with respect to the heat exchanger assembly 104 (i.e., a "draw through" configuration), or upstream with respect to the heat exchanger assembly 104 (i.e., a "blow through" configuration), as shown in FIG. 1.

The heat exchanger assembly 104 is part of a closed loop refrigeration circuit through which refrigeration (not shown separately from the heat exchanger assembly 104) flows. The heat exchanger assembly 104 can include any of a plurality of configurations. As illustrated in FIG. 1, the heat exchanger assembly 104 includes one or more heat exchanger coils 108, which can be arranged in a non-linear configuration. For example, the heat exchanger assembly 104 can have a generally V-shaped configuration, a generally A-shaped configuration, or a generally N-shaped configuration, or any other suitable configuration as is known in the art. In other embodiments, the heat exchanger assembly 104 can include a single heat exchanger coil 108 arranged at an angle with respect to the flow path of air A through the cabinet 102. In embodiments where the furnace coil or fan coil unit 100 is operable to provide cool air, the heat exchanger assembly 104 absorbs heat from the air A passing through the heat exchanger assembly 104 and the resultant cool air A is provided to a space to be conditioned. It should be understood that the refrigeration system illustrated herein is intended as an example only and that a HVAC system 100 having any suitable configuration is within the scope of the disclosure.

With continued reference to FIG. 1, the refrigerant circulating within the heat exchanger assembly 104 can, in rare instances, leak. When utilizing A2L refrigerants, a leak of refrigerant could lead to undesirable consequences due to the mildly flammable nature of A2L refrigerants. It should be appreciated that other refrigerants, beyond A2L refrigerants, are within the scope of the disclosure. Accordingly, the HVAC system 100 can include the leak detection system 126 operable to detect a refrigerant leak of the cabinet 102. The leak detection system 126 includes a sensor network 110 and a controller 120, configured and arranged as shown. The controller 120 includes a sensor-reading context analyzer 122; and the sensor network 110 includes refrigerant sensor(s) (or triggering sensor) 112 and refrigerant-sensor context sensor(s) (or triggering-sensor context sensor(s)) 114.

In embodiments, the refrigerant sensor(s) 112 can be coupled to the cabinet 102 in a way that allows the refrigerant sensor 112 to measure parameters of the refrigerant (not shown separately) that can provide an indication of a refrigerant leak. As a non-limiting example, the refrigerant parameter can be a concentration of the refrigerant in the heat exchanger assembly 104 because the concentration of the refrigerant in the heat exchanger assembly 104 can provide an indication of whether or not refrigerant is leaking from the system 100 (i.e., refrigerant concentration in the system 100 increases where fluid is leaking from the system 100). Examples of the refrigerant sensor(s) 112 include but are not limited to a point sensor and a line of sight or beam sensor. Further, the technologies used by one or more of the refrigerant sensors 112 can include non-dispersive infrared (NDIR), photoacoustic spectroscopy (PAS), quantum cascade laser spectroscopy (QCLS), tunable diode laser spectroscopy (TDLS), thermal conductivity (TC), metal oxide semiconductor (MOS), ultrasonic, speed of sound, and ultraviolet spectroscopy for example. However, it should be understood that any suitable type of refrigerant sensor 112 is within the scope of the disclosure.

In embodiments, the refrigerant-sensor context sensor(s) 114 can be any suitable sensor or sensor assembly that measures parameters of the context or conditions in which the refrigerant sensor(s) 112 operate. For example, refrigerant sensor(s) 112 can be positioned near the heat exchanger assembly 104 so that the refrigerant sensor(s) 112 will be exposed to the high/low humidity and temperature cycles that result from the heat exchanger assembly 104 cycling through blowing cold air, warm air, cold air, warm air, etc. These high/low humidity and temperature cycles can result in condensation forming on the refrigerant sensor(s) 112, which can result in the refrigerant sensor(s) 112 registering a false positive (i.e., signaling that refrigerant is leaking when in fact no refrigerant leakage has occurred). In some embodiments, the refrigerant-sensor context sensor(s) 114 can include any suitable sensor for measuring ambient humidity to which the refrigerant sensor(s) are exposed. In some embodiments, the refrigerant-sensor context sensor(s) 114 can include any suitable sensor for measuring ambient temperature to which the refrigerant sensor(s) are exposed.

In embodiments, the controller 120 includes the sensor-reading context analyzer module 122, which is operable to analyze the outputs from the sensor network 110 to determine whether or not refrigerant is leaking from the system 100. Because the outputs from the sensor network 110 include outputs from the refrigerant-sensor context sensor(s) 114, operating conditions that can impact how the refrigerant sensor(s) 112 operate are taken into account by the sensor-reading context analyzer 122 so that false alarm conditions can be reduced and, in most instances, averted.

Figure 4:
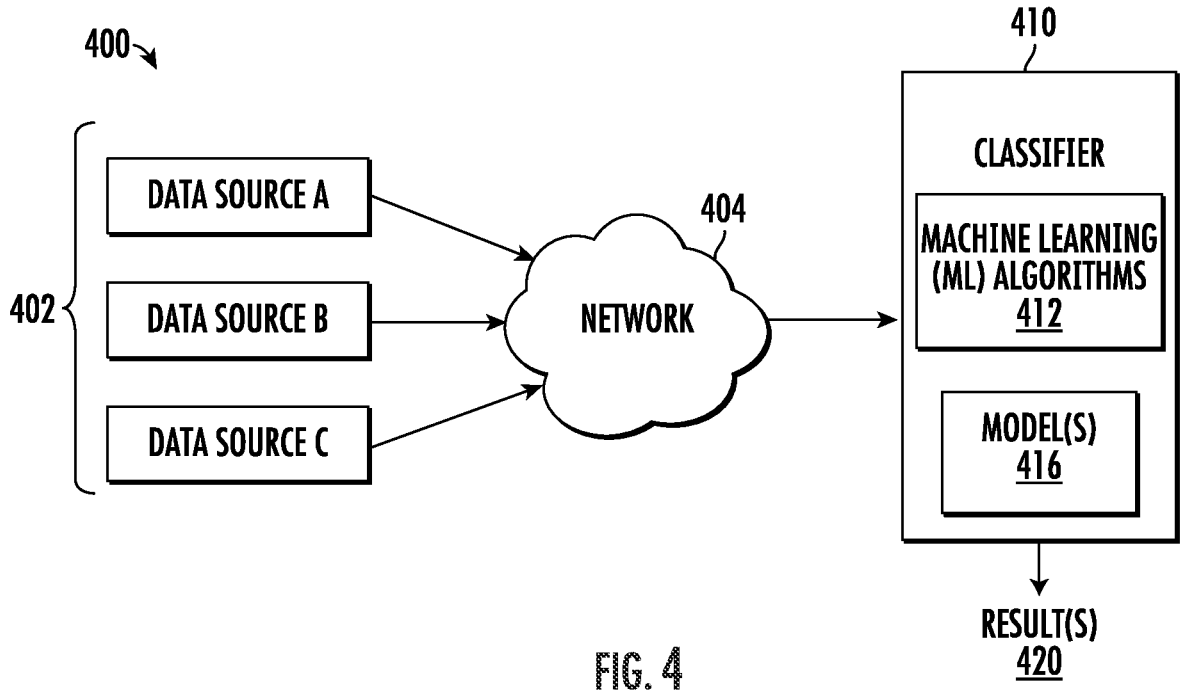
FIG. 4 is a block diagram illustrating how the portions of the novel sensor-reading context analysis can be implemented using a classifier according to an embodiment.

In some aspects, the sensor-reading context analyzer 122 utilizes a classifier having machine learning algorithms (e.g., classifier 410 and machine learning algorithms 412 shown in FIG. 4) trained to determine whether features of the outputs from the sensor network 110 match the features of a refrigerant leak event. In some aspects, the machine learning algorithms extract features from how the outputs from the sensor network 110 change over time. In some aspects, the classifier is trained using a training dataset developed from lab-based experimental tests and in-use tests applied to the refrigerant sensor(s) 112. As a non-limiting example, outputs from the refrigerant sensor(s) 112 can include refrigerant concentration; and the outputs from the refrigerant-sensor context sensor(s) 114 can include ambient humidity and/or ambient temperature to which the refrigerant sensor(s) 112 are or have been exposed. Accordingly, embodiments described herein improve the trustworthiness of the refrigerant sensor(s) 112 by greatly reducing false alarm rates with no or little compromise in detection rate; reducing refrigerant system downtime; and reducing the need for service visits from technicians in response to leak detection system false alarms.

In embodiments, the controller 120 is operably coupled to the sensor network 110 and to a motor (not shown separately) of the blower 106. In addition, a thermostat 130 for selecting a temperature demand of the area to be conditioned by the HVAC system 100 is arranged in communication with the controller 120. The controller 120 is operable to control operation of the furnace coil or fan coil unit 100 in response to the temperature setting of the thermostat 130.

Responsive to the controller 120 determining that a refrigerant leak event has occurred, the leak detection system 126 enters an alarm state and the controller 120 is operable to operate the HVAC system 100 in a first mode. In the first mode, the controller 120 can be made operable to isolate one or more possible ignition sources by turning off the HVAC system 100 as needed. For example, in embodiments where the HVAC system 100 includes a non-communicating thermostat, the controller 120 could cut power to the thermostat 130 to prevent calls for heat and/or cooling provided to the thermostat 130 from being communicated to the controller 120 and activating the HVAC system 100. In embodiments where the thermostat is a communicating thermostat, isolating one or more possible ignition sources includes de-energizing HVAC operating circuits directly, such as the furnace ignition circuit, AC compressor circuit, etc. In addition, during operation in the first mode, the controller 120 can be made operable to initiate operation of a blower 106. Operation of the blower 106 is intended to dissipate the refrigerant within the atmosphere.

Figure 2:
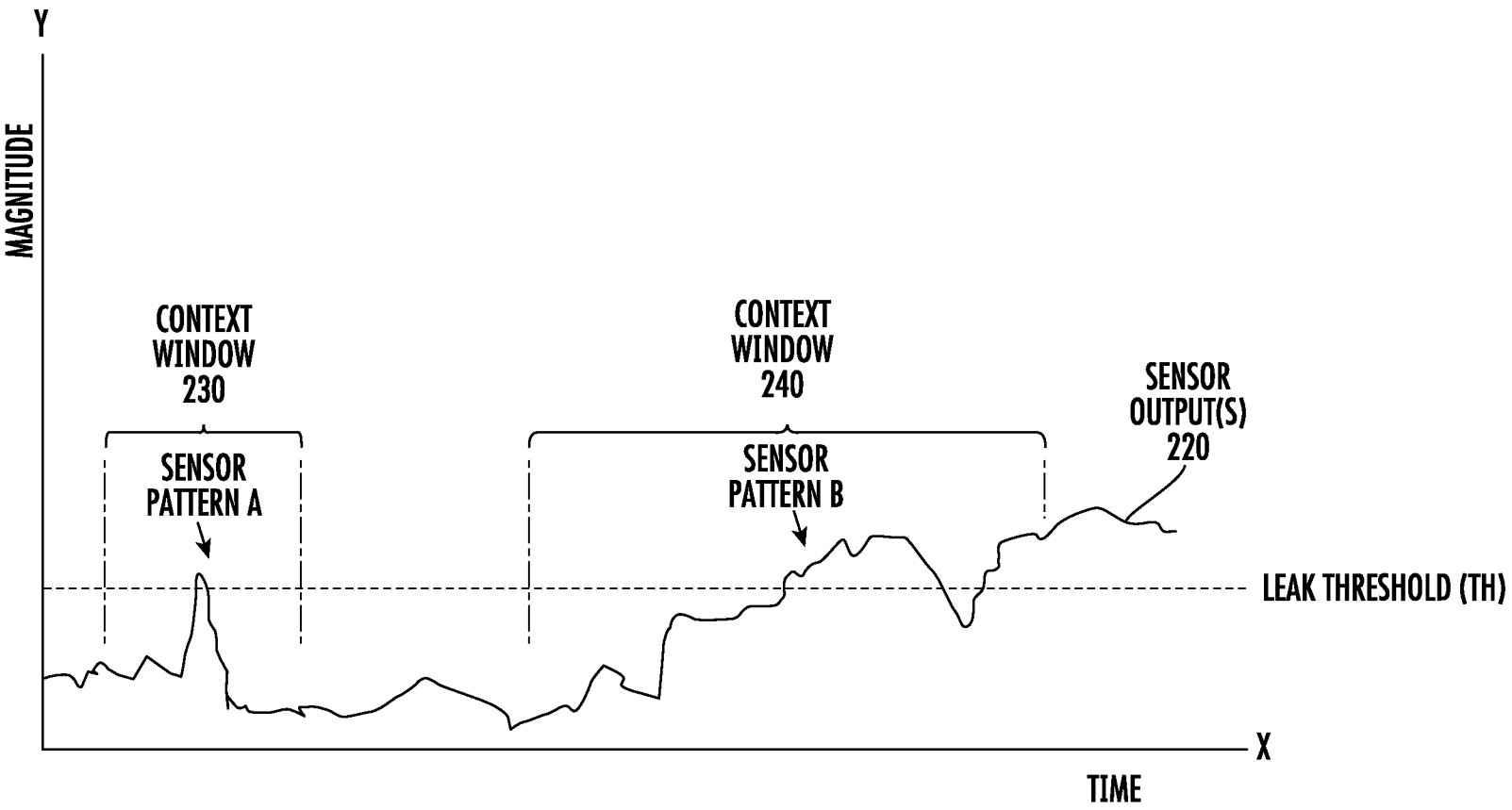
FIG. 2 is a simplified plot diagram illustrating context windows and sensor network output patterns used in a novel sensor-reading context analysis according to an embodiment.
Figure 3:
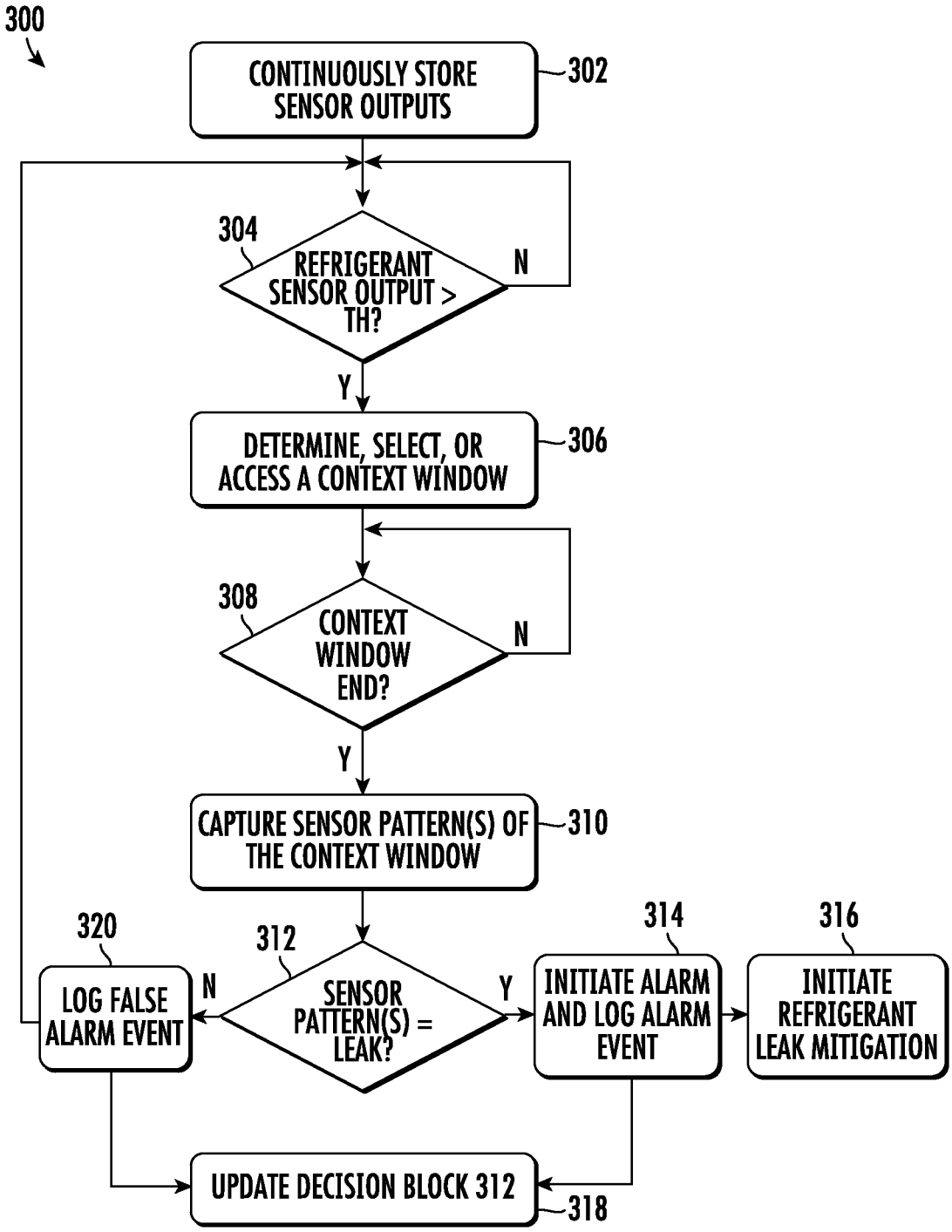
FIG. 3 is a flow diagram of an exemplary method of operating a detection assembly using a novel sensor-reading context analysis according to an embodiment.

Additional details of how embodiments of the leak detection system 126 can be implemented are shown in FIGS. 2 and 3. FIG. 2 is a simplified plot diagram, and FIG. 3 is a flow diagram illustrating a methodology 300. More specifically, FIG. 2 is a plot diagram illustrating a simplified example of sensor output(s) 220 of the sensor network 110, content windows 230, 240, sensor patterns A, B, and a leak threshold (Th), that can be utilized by the sensor-reading context analyzer 122 (shown in FIG. 1) to perform the methodology 300 shown in FIG. 3.

The methodology 300 will now be described with reference to the leak detection system 126 shown in FIG. 1, the simplified plot diagram shown in FIG. 2, and the flow diagram shown in FIG. 3. Turning first to FIG. 3, the methodology 300 begins at block 302 by using the sensor network 110 (shown in FIG. 1) to make continuous sensor readings or measurements, and by using the controller 120 (shown in FIG. 1) to receive and store the sensor readings or measurements. FIG. 2 provides a simplified representation of the sensor readings of the sensor network 110 as sensor output(s) 220. The sensor output(s) 220 are simplified in that they represent a combination of sensor readings generated over time by the refrigerant sensor(s) 112 and the refrigerant-sensor context sensor(s) 114. In practice, each instance of the refrigerant sensor(s) 112 and the refrigerant-sensor context sensor(s) 114 generates its own sensor output. The sensor output(s) 220 are further simplified in that the change in magnitude over time in FIG. 2 is random and provided for ease of illustration and explanation. The pattern of the output(s) 220 is not intended to represent an actual or expected change in magnitude over time for the sensor readings generated by the sensor network 110. The output(s) 220 are intended to illustrate that the magnitude of the sensor readings from the sensor network 110 change over time, and are further intended to illustrate that the magnitude of the output(s) can exceed a leak threshold (Th) value. In some embodiments, the leak Th corresponds to a threshold for sensor readings from the sensor network 110, where the threshold functions as a trigger to capture the context window (e.g., context window 230 and/or context window 240 shown in FIG. 2) and the associated sensor output pattern (e.g., sensor output pattern A and/or context output pattern B shown in FIG. 2) that will be analyzed by the sensor-readings context analyzer 122 (shown in FIG. 1). In some embodiments, sensor readings from the refrigerant sensor(s) 112 function as the trigger, and the leak Th is a value of sensor reading from the refrigerant sensor(s) 112 that provide a preliminary indication that the refrigerant sensor(s) 112 may or may not have detected a refrigerant leak in the system 100 (shown in FIG. 1). In accordance with embodiments, the sensor-reading context analyzer 122 performs additional analysis using the information depicted in FIG. 2 to determine whether the preliminary indication that the refrigerant sensor(s) 112 may or may not have detected a refrigerant leak represents an actual refrigerant leak or a false alarm.

Returning to the methodology 300 shown in FIG. 3, from block 302 the methodology 300 moves to decision block 304 where the controller 120 (shown in FIG. 1) monitors the sensor outputs stored at block 302 to determine when the portion of the sensor output(s) 220 generated by the refrigerant sensor(s) 112 exceeds the leak Th (shown in FIG. 2). If the answer to the inquiry at decision block 304 is no, the methodology 300 returns to the input of decision block 304 and continues to monitor the sensor outputs stored at block 302. If the answer to the inquiry at decision block 304 is yes, the methodology 300 moves to block 306 where the controller 120 determines, selects, and/or accesses a context window context window 230 and/or context window 240 shown in FIG. 2) around the point in time where the portion of the sensor output(s) 220 generated by the refrigerant sensor(s) 112 exceeds the leak Th. In general, the width or duration of the context window needs to be large enough such that the sensor pattern (e.g., sensor output pattern A and/or sensor output pattern B shown in FIG. 2) defined by the context window provides sufficient data for the sensor pattern analysis at decision block 312. In some embodiments, the width or size of the context window is selected in advance of initiating the methodology 300. In some embodiments, the width or size of the context window is determined dynamically by the sensor-reading, context analyzer 122 using the sensor output(s) 220. For example, where the sensor-reading context analyzer 122 includes a classifier (e.g., classifier 410 shown in FIG. 4), the classifier can be trained to dynamically selected the context window based on a dynamic determination of the width or duration of the sensor output pattern (e.g., sensor output pattern A and/or sensor output pattern B) needed in order to determine at a sufficiently high confident level whether sensor readings from the refrigerant sensor(s) 112 exceeding leak Th represent an actual refrigerant leak or a false alarm.

At decision block 308, the controller 120 determines whether or not the selected or determined context window has ended. If the answer to the inquiry at decision block 308 is no, the methodology 300 returns to the input the decision block 308. If the answer to the inquiry at decision block 308 is yes, the context window has closed or ended, and the methodology 300 moves to block 310 where the controller 120 captures the sensor output pattern (e.g., sensor output pattern A and/or sensor output pattern B shown in FIG. 2) of the selected context window (e.g., context window 230 and/or context window 240 shown in FIG. 2).

From block 310, the methodology 300 moves to decision block 312, where the controller 120 and the sensor-reading context analyzer 122 evaluate the sensor pattern captured at block 310 to determine whether the refrigerant sensor output exceeding leak Th at decision block 304 represents an actual refrigerant leak or a false alarm. In some embodiments, the analysis performed by the sensor-reading context analyzer 122 at decision block 304 utilizes a classifier (e.g., classifier 410 shown in FIG. 4) having machine learning algorithms (e.g., machine learning algorithms 412 shown in FIG. 4) trained to determine whether features of the sensor pattern match the features of a refrigerant leak event. In some aspects, the machine learning algorithms extract features from the sensor pattern changes over time. In some embodiments, the classifier is trained using a training dataset developed from lab-based experimental tests and in-use tests applied to the refrigerant sensor(s) 112.

If the answer to the inquiry at decision block 312 is no, the methodology 300 moves to block 320 and logs the various aspects of the evaluations at decision block 304 and decision block 312 as a false alarm. From block 320, the methodology 300 branches to block 318 and to another iteration of decision block 304 and the overall methodology 300. In embodiments where the evaluation at decision block 312 is performed by a trained classifier (e.g., the classifier 410 shown in FIG. 4), block 318 uses the false alarm event logged at block 320 to update the trained classifier of decision block 312, If the answer to the inquiry at decision block 312 is yes, the methodology 300 moves to block 314 where the controller 120 initiates alarm and logs the alarm as an alarm event. From block 314, the methodology 300 branches to block 318 and block 316. In embodiments where the evaluation at decision block 312 is performed by a trained classifier, block 318 uses the alarm event logged at block 314 to update the trained classifier of decision block 312. At block 316, the methodology 300 initiates a refrigerant leak response strategy, Which can include shutting down the HVAC system 100 (shown in FIG. 1) or initiating a service call.

Additional details of machine learning techniques that can be used to implement functionality of the controller 120 and/or the sensor-reading context analyzer 122 will now be provided. The various classification, prediction and/or determination functionality of the controllers or processors described herein can be implemented using machine learning and/or natural language processing techniques. In general, machine learning techniques are run on so-called "learning machines," which can be implemented as programmable computers operable to run sets of machine learning algorithms and/or natural language processing algorithms. Machine learning algorithms incorporate knowledge from a variety of disciplines, including neurophysiology, cognitive science/psychology, physics (statistical mechanics), control theory, computer science, artificial intelligence, statistics/mathematics, pattern recognition, computer vision, parallel processing and hardware (e.g., digital/analog/VLSI/optical).

The basic function of learning machines and their machine learning algorithms is to recognize patterns by interpreting unstructured sensor data through a kind of machine perception. Unstructured real-world data in its native form (e.g., images, sound, text, or time series data) is converted to a numerical form (e.g., a vector having magnitude and direction) that can be understood and manipulated by a computer. The machine learning algorithm performs multiple iterations of learning-based analysis on the real-world data vectors until patterns (or relationships) contained in the real-world data vectors are uncovered and learned. The learned patterns/relationships function as predictive models that can be used to perform a variety of tasks, including, for example, classification (or labeling) of real-world data and clustering of real-world data. Classification tasks often depend on the use of labeled datasets to train the classifier (i.e., the model) to recognize the correlation between labels and data. This is known as supervised learning. Examples of classification tasks include identifying objects in images (e.g., stop signs, pedestrians, lane markers, etc.), recognizing gestures in video, detecting voices, detecting voices in audio, identifying particular speakers, transcribing speech into text, and the like. Clustering tasks identify similarities between objects, which the clustering task groups according to those characteristics in common and which differentiate them from other groups of objects. These groups are known as "clusters."

An example of machine learning techniques that can be used to implement embodiments of the disclosure will be described with reference to FIGS. 4 and 5. FIG. 4 depicts a block diagram showing a classifier system 400 capable of implementing various predicting and determining aspects of the embodiments described herein. More specifically, the functionality of the system 400 is used in embodiments of the disclosure to generate various models and/or sub-models that can be used to implement predicting and determining functionality in embodiments of the disclosure. The classifier system 400 includes multiple data sources 402 in communication (e.g., through a network 404) with a classifier 410. In some embodiments of the disclosure, the data sources 402 can bypass the network 404 and feed directly into the classifier 410. The data sources 402 provide data/information inputs that will be evaluated by the classifier 410 in accordance with embodiments of the disclosure. The data sources 402 also provide data/information inputs that can be used by the classifier 410 to train and/or update model(s) 416 created by the classifier 410. The data sources 402 can be implemented as a wide variety of data sources, including but not limited to, sensors operable to gather real time data, data repositories (including training data repositories), and outputs from other classifiers. The network 404 can be any type of communications network, including but not limited to local networks, wide area networks, private networks, the Internet, and the like.

Figure 6:
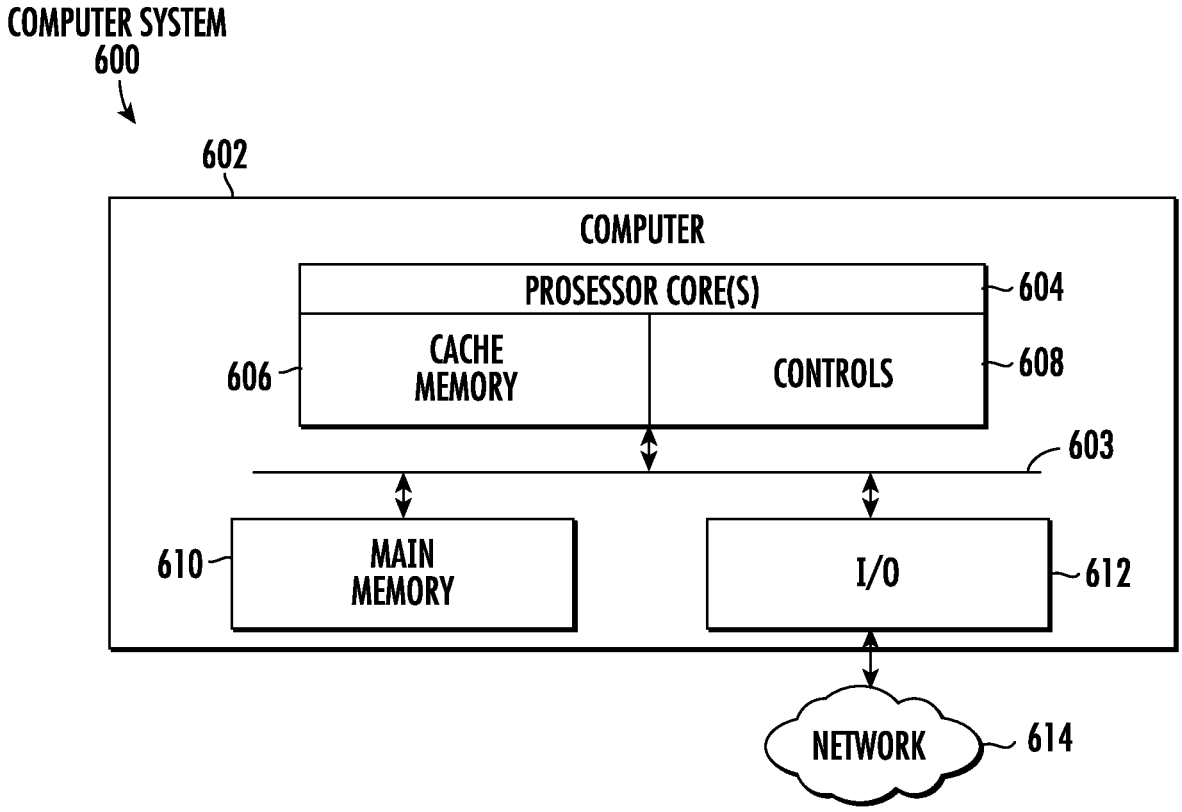
FIG. 6 is a block diagram of a programmable computer system operable to implement aspects of a controller of the HVAC system shown in FIG. 1.

The classifier 410 can be implemented as algorithms executed by a programmable computer such as the computing system 600 (shown in FIG. 6). As shown in FIG. 4, the classifier 410 includes a suite of machine learning (ML) algorithms 412; and model(s) 416 that are relationship (or prediction) algorithms generated (or learned) by the ML algorithms 412. The algorithms 412, 416 of the classifier 410 are depicted separately for ease of illustration and explanation. In embodiments of the disclosure, the functions performed by the various algorithms 412, 416 of the classifier 410 can be distributed differently than shown. In some embodiments of the disclosure, natural language processing (NLP) algorithms can be integrated within the ML algorithms 412.

Figure 5:
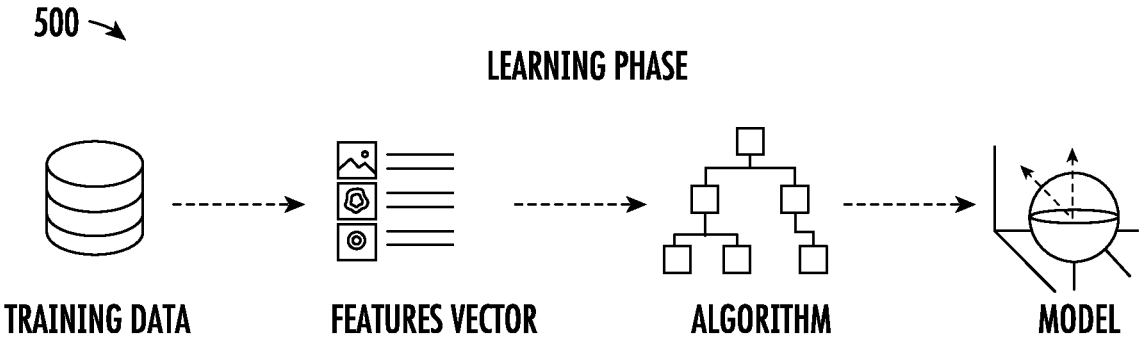
FIG. 5 is a block diagram of learning phase functionality that can be used to train the classifier shown in FIG. 4.

Referring now to FIGS. 4 and 5 collectively, FIG. 5 depicts an example of a learning phase 500 performed by the ML algorithms 412 to generate the above-described models 416. In the learning phase 500, the classifier 410 extracts features from the training data and coverts the features to vector representations that can be recognized and analyzed by the ML algorithms 412. The features vectors are analyzed by the ML algorithm 412 to "classify" the training data against the target model (or the model's task) and uncover relationships between and among the classified training data. Examples of suitable implementations of the ML algorithms 412 include but are not limited to neural networks, support vector machines (SVMs), logistic regression, decision trees, hidden Markov Models (HMMs), etc. The learning or training performed by the ML algorithms 412 can be supervised, unsupervised, or a hybrid that includes aspects of supervised and unsupervised learning. Supervised learning is when training data is already available and classified/labeled. Unsupervised learning is when training data is not classified/labeled so must be developed through iterations of the classifier 410 and the ML algorithms 412. Unsupervised learning can utilize additional learning/training methods including, for example, clustering, anomaly detection, neural networks, deep learning, and the like.

When the models 416 are sufficiently trained by the ML algorithms 412, the data sources 402 that generate "real world" data are accessed, and the "real world" data is applied to the models 416 to generate usable versions of the results 420. In some embodiments of the disclosure, the results 420 can be fed back to the classifier 410 and used by the ML algorithms 412 as additional training data for updating and/or refining the models 416.

FIG. 6 illustrates an example of a computer system 600 that can be used to implement the controller 120 described herein. The computer system 600 includes an exemplary computing device ("computer") 602 configured for performing various aspects of the content-based semantic monitoring operations described herein in accordance embodiments of the disclosure. In addition to computer 602, exemplary computer system 600 includes network 614, which connects computer 602 to additional systems (not depicted) and can include one or more wide area networks (WANs) and/or local area networks (LANs) such as the Internet, intranet(s), and/or wireless communication network(s). Computer 602 and additional system are in communication via network 614, e.g., to communicate data between them.

Exemplary computer 602 includes processor cores 604, main memory ("memory") 610, and input/output component(s) 612, which are in communication via bus 603. Processor cores 604 includes cache memory ("cache") 606 and controls 608, which include branch prediction structures and associated search, hit, detect and update logic, which will be described in more detail below. Cache 606 can include multiple cache levels (not depicted) that are on or off-chip from processor 604. Memory 610 can include various data stored therein, e.g., instructions, software, routines, etc., which, e.g., can be transferred to/from cache 606 by controls 608 for execution by processor 604. Input/output component(s) 612 can include one or more components that facilitate local and/or remote input/output operations to/from computer 602, such as a display, keyboard, modem, network adapter, etc. (not depicted).

Embodiments of the disclosure described herein can be a system, a method, and/or a computer program product at any possible technical detail level of integration. The computer program product can include a computer readable storage medium (or media) having computer readable program instructions thereon for causing a controller or processor to carry out aspects of the embodiments of the disclosure.

The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A detection assembly operable to detect a refrigerant leak event, the detection assembly comprising:

a sensor network operable to generate sensor outputs comprising triggering-sensor (TS) outputs and triggering-sensor context (TSC) outputs; and a controller operable to perform a sensor-reading context analysis on the sensor outputs;

wherein the sensor-reading context analysis comprises:

accessing a set of the sensor outputs comprising the TS outputs and the TSC outputs that occurred within a context time window; and determining that a pattern of the set of sensor outputs represents the refrigerant leak event.

2. The detection assembly of claim 1, wherein the controller comprises a classifier operable to execute a machine learning algorithm trained to perform the sensor-reading context analysis as a classification task.

3. The detection assembly of claim 2, wherein the machine learning algorithm has been trained using a training dataset comprising:

experimental data that results from experimental tests applied to the detection assembly; and in-use data that results from in-use operations of the detection assembly.

4. The detection assembly of claim 1, wherein the sensor-reading context analysis further comprises determining a duration of the context time window based at least in part on a determination of an amount of the sensor outputs that are needed to perform the determining that the pattern of the set of sensor outputs represents the refrigerant leak event.

5. The detection assembly of claim 1, wherein:

accessing the set of the sensor outputs comprising the TS outputs and the TSC outputs that occurred within the context time window is based at least in part on a determination that at least one of the TS outputs represents a triggering event; and the triggering event comprises the at least one of the TS outputs exceeding a threshold.

6. The detection assembly of claim 5, wherein the at least one of the TS outputs comprises a parameter of a refrigerant flowing through a closed loop refrigeration circuit.

7. The detection assembly of claim 6, wherein the parameter comprises a concentration.

8. The detection assembly of claim 1, wherein the sensor network comprises:

a triggering sensor operable to generate the TS outputs; and a first type of context sensor operable to generate a first type of the TSC outputs.

9. The detection assembly of claim 8, wherein the sensor network further comprises a second type of context sensor operable to generate a second type of the TSC outputs.

10. The detection assembly of claim 9, wherein:

the first type of the TSC outputs comprises temperature data that represents ambient temperature of the triggering sensor; and the second type of the TSC outputs comprises humidity data that represents ambient humidity of the triggering sensor.

11. A method of operating a detection assembly to detect a refrigerant leak event, the method comprising:

using a sensor network to generate sensor outputs comprising triggering-sensor (TS) outputs and triggering-sensor context (TSC) outputs; and using a controller to perform a sensor-reading context analysis on the sensor outputs;

wherein the sensor-reading context analysis comprises:

accessing a set of the sensor outputs comprising the TS outputs and the TSC outputs that occurred within a context time window; and determining that a pattern of the set of sensor outputs represents the refrigerant leak event.

12. The method of claim 11, wherein the controller comprises a classifier operable to execute a machine learning algorithm trained to perform the sensor-reading context analysis as a classification task.

13. The method of claim 12, wherein the machine learning algorithm has been trained using a training dataset comprising:

experimental data that results from experimental tests applied to the detection assembly; and in-use data that results from in-use operations of the detection assembly.

14. The method of claim 11, wherein the sensor-reading context analysis further comprises determining a duration of the context time window based at least in part on a determination of an amount of the sensor outputs that are needed to perform the determining that the pattern of the set of sensor outputs represents the refrigerant leak event.

15. The method of claim 11, wherein:

accessing the set of the sensor outputs comprising the TS outputs and the TSC outputs that occurred within the context time window is based at least in part on a determination that at least one of the TS outputs represents a triggering event; and the triggering event comprises the at least one of the TS outputs exceeding a threshold.

16. The method of claim 15, wherein the at least one of the TS outputs comprises a parameter of a refrigerant flowing through a closed loop refrigeration circuit.

17. The method of claim 16, wherein the parameter comprises a concentration.

18. The method of claim 11, wherein the sensor network comprises:

a triggering sensor operable to generate the TS outputs; and a first type of context sensor operable to generate a first type of the TSC outputs.

19. The method of claim 18, wherein the sensor network further comprises a second type of context sensor operable to generate a second type of the TSC outputs.

20. The method of claim 19, wherein:

the first type of the TSC outputs comprises temperature data that represents ambient temperature of the triggering sensor; and the second type of the TSC outputs comprises humidity data that represents ambient humidity of the triggering sensor.

* * * * *